United States Patent [19]

Wolk et al.

[11] Patent Number: 4,853,692

[45] Date of Patent: Aug. 1, 1989

[54] INFANT SECURITY SYSTEM

[76] Inventors: Barry M. Wolk, 58 Graymoor La., Olympia Fields, Ill. 60461; Edward H. Newman, 2371 Bryden Rd., Columbus, Ohio 43209

[21] Appl. No.: 129,627

[22] Filed: Dec. 7, 1987

[51] Int. Cl.[4] ..... G08B 23/00; G08B 13/14

[52] U.S. Cl. ..... 340/573; 340/539; 340/572

[58] Field of Search ..... 340/573, 572, 571, 539, 340/525, 521; 455/7

[56] References Cited

U.S. PATENT DOCUMENTS

| | | | |
|---|---|---|---|
| 2,818,477 | 12/1956 | Gollhofer | 200/85 R |
| 3,478,344 | 11/1969 | Schwitzgebel et al. | 340/539 |
| 3,618,067 | 11/1971 | DeVale et al. | 340/572 X |
| 3,665,448 | 5/1972 | McGlinchey et al. | 340/539 |
| 3,713,133 | 1/1973 | Nathans | 340/572 X |
| 4,063,229 | 12/1977 | Welsh et al. | 340/571 |
| 4,136,338 | 1/1979 | Antenore | 340/551 |
| 4,555,696 | 11/1985 | Brown | 340/572 X |
| 4,593,273 | 6/1986 | Narcisse | 340/539 |
| 4,598,272 | 7/1986 | Cox | 340/573 X |
| 4,598,275 | 7/1986 | Ross et al. | 340/573 |
| 4,682,155 | 7/1987 | Shirley | 340/573 |
| 4,684,933 | 8/1987 | Dill | 340/572 |
| 4,686,513 | 8/1987 | Farrar et al. | 340/572 |
| 4,694,284 | 9/1987 | Leveille et al. | 340/573 X |
| 4,736,196 | 4/1988 | McMahon et al. | 340/573 |

FOREIGN PATENT DOCUMENTS

| | | | |
|---|---|---|---|
| 0176090 | 4/1986 | European Pat. Off. | 340/573 |
| 2543715 | 10/1984 | France | 340/573 |

*Primary Examiner*—Glen R. Swann, III
*Assistant Examiner*—Thomas J. Mullen, Jr.
*Attorney, Agent, or Firm*—Nixon & Vanderhye

[57] ABSTRACT

An infant security system is disclosed which includes a transmitting device that generates at least two uniquely coded signals and is disposed around the leg or ankle of infants in a hospital maternity ward, children's ward or the like. An activated magnetic strip is also attached to the transmitting device. An associated receiver is placed, for example, on the cart containing the infants' crib or bassinet which will typically be close enough to the infant so that it is well enough within the range of the transmitter. Every few seconds the RF transmitter transmits a coded RF pulse. If an infant with an attached RF transmitter is removed by some predetermined minimum distance from its associated RF receiver or if the RF transmitter becomes inoperative or is shielded, then the RF receiver will not receive the transmitted coded signal which will trigger an alarm. If a kidnapper attempts to detach the RF transmitter from the infant, a switch is opened which in turn causes the RF transmitter to emit a second coded signal. Upon detection of the second coded signal, an alarm in the RF receiver will be triggered. An alarm is also triggered if an activated magnetic strip on the RF transmitter is transported through a maternity ward exit point.

57 Claims, 4 Drawing Sheets

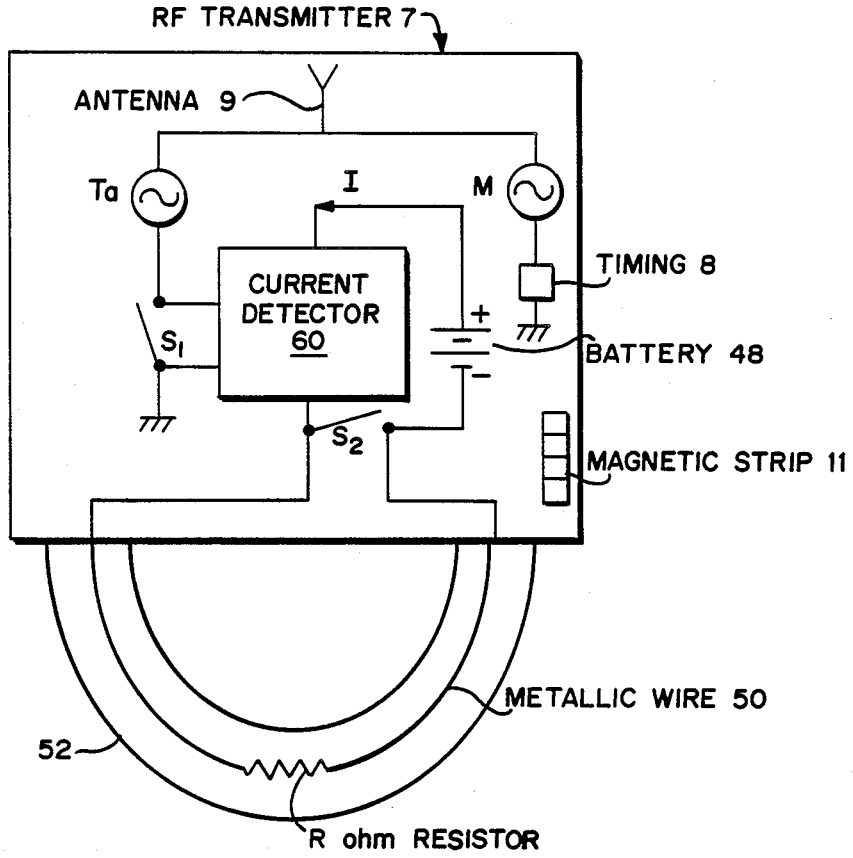
FIG. 4
FIG. 5
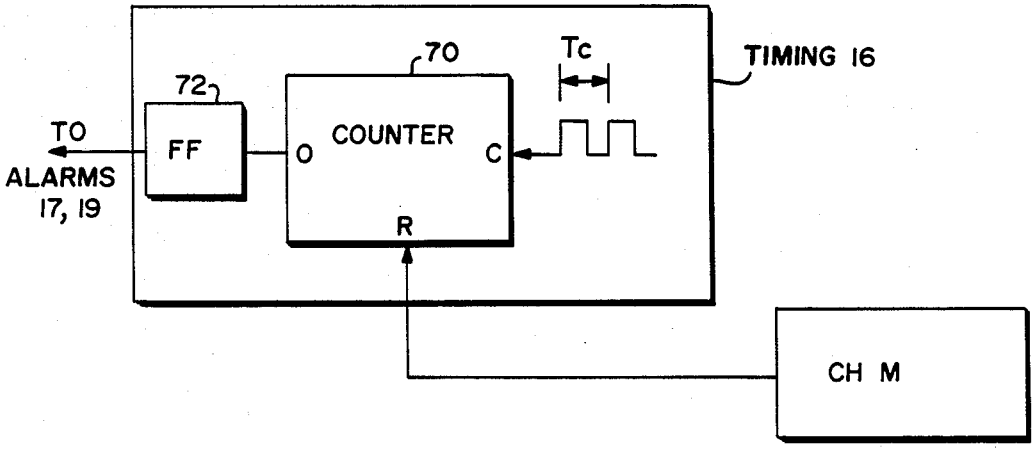

INFANT SECURITY SYSTEM

FIELD OF THE INVENTION

This invention generally relates to an electronic security system designed to thwart burglars and kidnappers and to insure that valuable objects remain within a prescribed area. More particularly, the invention relates to a hospital-based infant security system designed to prevent an infant from being kidnapped from a hospital maternity or children's ward.

BACKGROUND AND SUMMARY OF THE INVENTION

Child abduction is a major problem in this country and throughout the world, with the number of children abducted increasing from year to year. While the number of abducted children has increased so too has the brazenness of the abductors. In this regard, there has been far too many highly publicized kidnappings of newborn infants from closely monitored hospital maternity wards. Such infants have become attractive targets for kidnappers due to the high price paid in black market transactions for newborn infants and the absence of any risk of identification by the kidnapping victim.

The present invention provides hospital maternity wards with the maximum practical degree of security while avoiding the police state environment which would be created by posting uniformed security guards at every maternity ward exit. Rather than creating a police state environment, the present invention provides a passive security system requiring no human intervention except when it is turned on, turned off, or when an alarm is detected. At the same time, the system provides the hospital maternity ward with multiple levels of security thereby dramatically reducing the likelihood of an infant being successfully kidnapped from the hospital.

In an exemplary embodiment of the present invention, infants in a hospital maternity ward are supplied with a very small radio frequency (RF) transmitter capable of transmitting a plurality of coded signals. A corresponding remote RF receiver tuned to receive the transmitted coded signals is associated with each transmitter. The main functions of the RF transmitter and receiver are to insure that (1) the RF transmitter remains attached to the infant and (2) the infant and the attached RF transmitter remain in the proximity of the corresponding receiver.

Each of the transmitters in the system includes a magnetic strip which generates a low frequency electromagnetic field when activated. The exit points of the hospital maternity ward (such as doors, elevators, stairways, etc.) are provided with a magnetic receiver which detects an activated magnetic strip passing through that exit point. Upon detecting the alternating electromagnetic field generated by the magnetic strip an associated audible alarm is sounded.

At the heart of the infant security system is the transmitting device which generates at least two uniquely coded signals and which is preferably snugly disposed around the leg or ankle of each of the infants. The associated receiver is placed, for example, on the cart containing the infant's crib or bassinet which will typically be close enough to the infant so that it is well enough within the range of the transmitter.

Every few seconds the RF transmitter will transmit, for example, a coded RF pulse. If an infant with an attached RF transmitter is removed by some predetermined minimum distance from its associated RF receiver, then the RF receiver will not receive the transmitted coded signal which will trigger an alarm. If the infant is placed in a metal container thereby preventing the transmitted signal from being received by the RF receiver, an alarm is likewise triggered.

If a kidnapper attempts to detach the RF transmitter from the infant, a switch is opened (or closed) which in turn causes the RF transmitter to emit a second coded signal. Upon detection of the second coded signal, an alarm in the RF receiver is triggered. In order to legitimately remove the infant from the maternity ward area, the magnetic strip associated with the transmitting device must be deactivated and the RF receiver deactivated with, for example, a security key.

While being primarily directed to a hospital-based infant security system, the present invention likewise contemplates that the security system may be used to secure a wide range of other valuable objects. For example, the system may be used to prevent a valuable art object from being improperly removed or stolen from its assigned room. Likewise, the present invention may be utilized to prevent a dangerous chemical from being improperly removed from its storage area. Alternatively, the security system of the present invention may be utilized to prevent an individual from leaving a designated area in any workplace, hospital, or institutional setting.

BRIEF DESCRIPTION OF THE DRAWINGS

These as well as other features of this invention will be better appreciated by reading the following detailed description of the presently preferred embodiment taken in conjunction with the accompanying drawings of which:

FIG. 4 is an RF transmitter and leg strap incorporating a monitored tamper loop;

FIG. 5 is an exemplary block diagram of timing circuit 16 shown in FIG. 1;

DETAILED DESCRIPTION OF THE DRAWINGS

Figure 1:
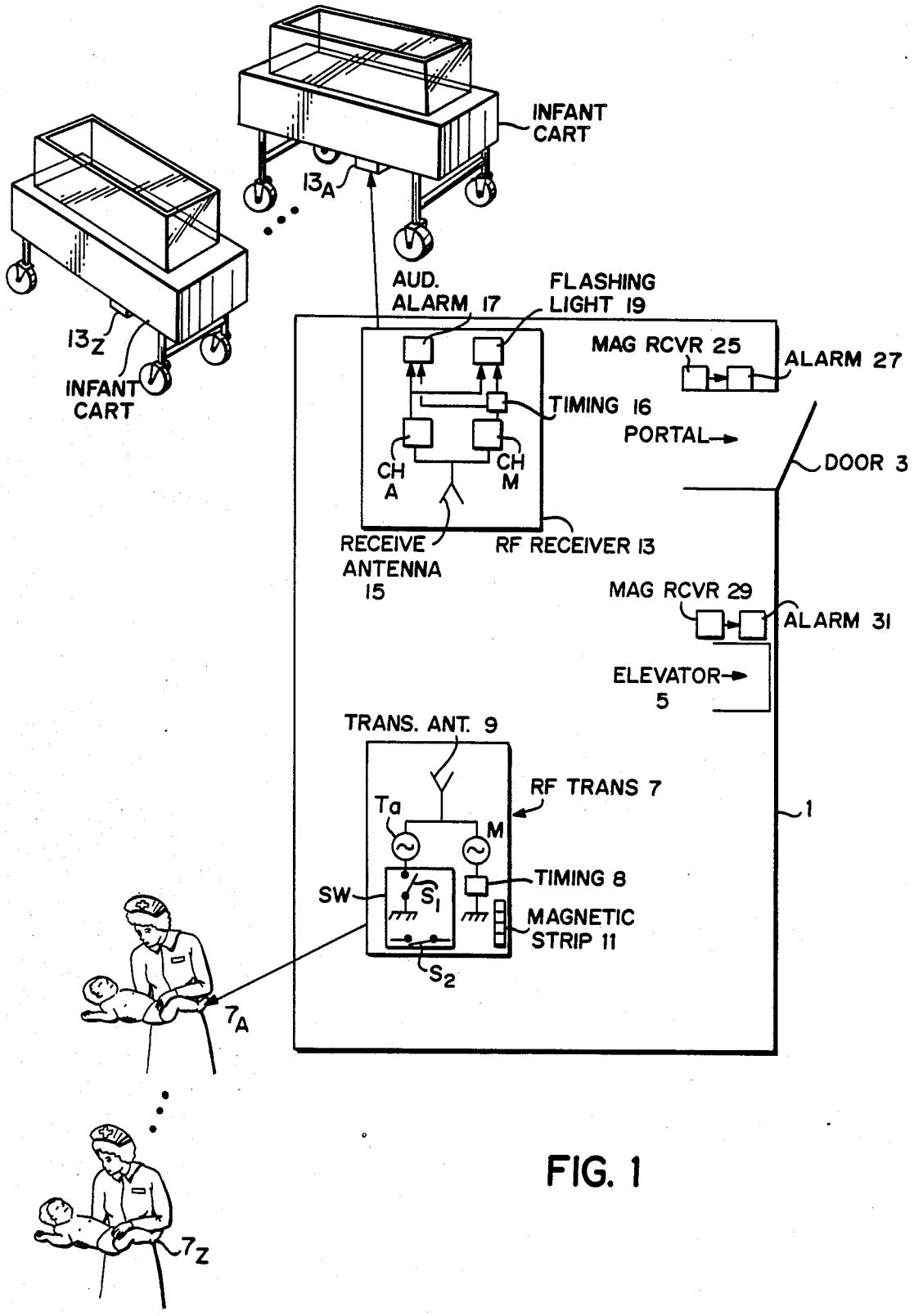
FIG. 1 is a block diagram of an exemplary embodiment of the security system of the present invention.

FIG. 1 schematically shows a portion of a hospital maternity ward 1. Such a maternity ward typically consists of one or more hallways off of which are various rooms for the nursery, mothers' beds, doctors' examinations, infant bathing, etc. Exit points from the maternity ward typically are through an exit door 3 or an elevator 5.

At the heart of the infant security system of the preferred embodiment of the present invention is RF transmitting module 7. As generally represented in FIG. 1, each infant in the maternity ward is provided with its own transmitting module 7A through 7Z. The RF transmitting module 7 is preferably attached to the infant by a plastic leg or ankle band as will be described in more detail in FIG. 3 below.

The RF transmitter module 7 contains two coded RF signal generators Ta and M, switching module Sw (which is only generally represented in FIG. 1), and a transmitting antenna 9. As will be appreciated by those skilled in the art, the transmitting antenna 9 should be impedance matched to the RF generators Ta and M. Additionally, the transmitting antenna 9 should have an omni-directional radiation pattern so that its position with respect to an associated RF receiver 13 is not critical (which is particularly important where infants are likely to be moved within the maternity ward).

If the security system is being utilized to protect stationary art objects as opposed to providing infant security, then the RF transmitter 7 can be energized from the available building service power. However, if the object to be secured is movable, e.g., an infant, then the RF transmitter 7 must be powered by an internal battery. In any event, battery power is highly desirable as a back up to insure that the security system will function in the event of a power failure.

Signal generator M is driven by a timing circuit 8 so as to generate a coded RF pulse, which will be referred to hereinafter as the maintenance signal m. Pulse m is emitted every $T_m$ seconds, where m is chosen to be sufficiently small so it is not possible for the infant to be removed too great a distance from an associated receiver 13 during the time period that it takes for several maintenance pulses m to be generated. On the other hand, $T_m$ should be selected such that pulse generation does not occur at a frequency that would create an excessive power drain on the transmitter battery. The maintenance signal generator M is directly connected to the transmitting antenna 9 so that all pulses generated are radiated.

Figure 2:
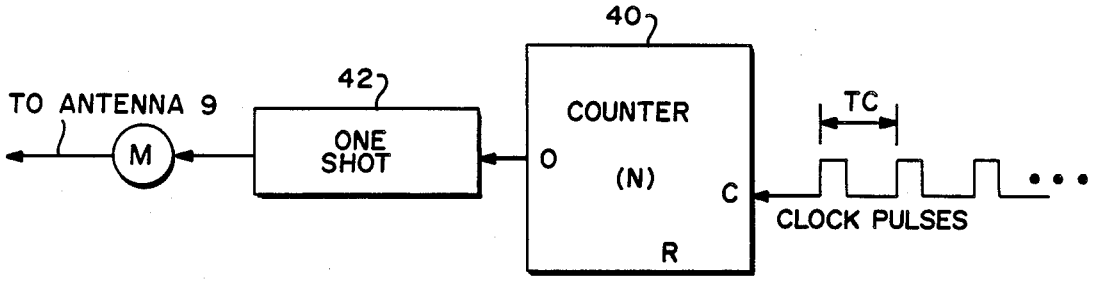
FIG. 2 is an exemplary block diagram of the timing circuit 8 shown in FIG. 1.

FIG. 2 schematically discloses an exemplary timing circuit 8 for driving maintenance signal generator M. Timing circuit 8 includes a source (not shown) of clock pulses having a period Tc. The clock pulses drive a counter 40 having a clock input C, an output O, and a reset input R.

The counter 40 generates at output O a transition from logical "0" to logical "1" after N clock pulses have been received. Monostable multivibrator (one shot) 42 generates an output pulse upon receiving a logical "0" to "1" transition from counter 40. By setting counter 40 such that N=Tm/Tc, then the output of one shot 42 will be a pulse every Tm seconds, thereby enabling the maintenance signal generator M to be appropriately driven as described above. The counter is designed so that after it has counted N clock pulses it automatically resets to begin another count.

Turning back to FIG. 1, the RF transmitting module 7 also includes a tamper signal generator Ta, which is an RF signal generator that generates a coded signal, hereafter denoted A. Since the tamper signal generator Ta is directly connected to the transmitting antenna 9 all generated coded signals A will be radiated.

Tamper signal generator Ta is connected to a switching module SW as generally shown in FIG. 1. The tamper generator Ta is turned on (or off) by placing switch S1 in the closed (or opened) position. Switch S1 works in conjunction with switch S2 so that when switch S2 is open, switch S1 is closed. Conversely, when switch S2 is closed, switch S1 is opened, as is schematically represented in FIG. 1.

Figure 3:
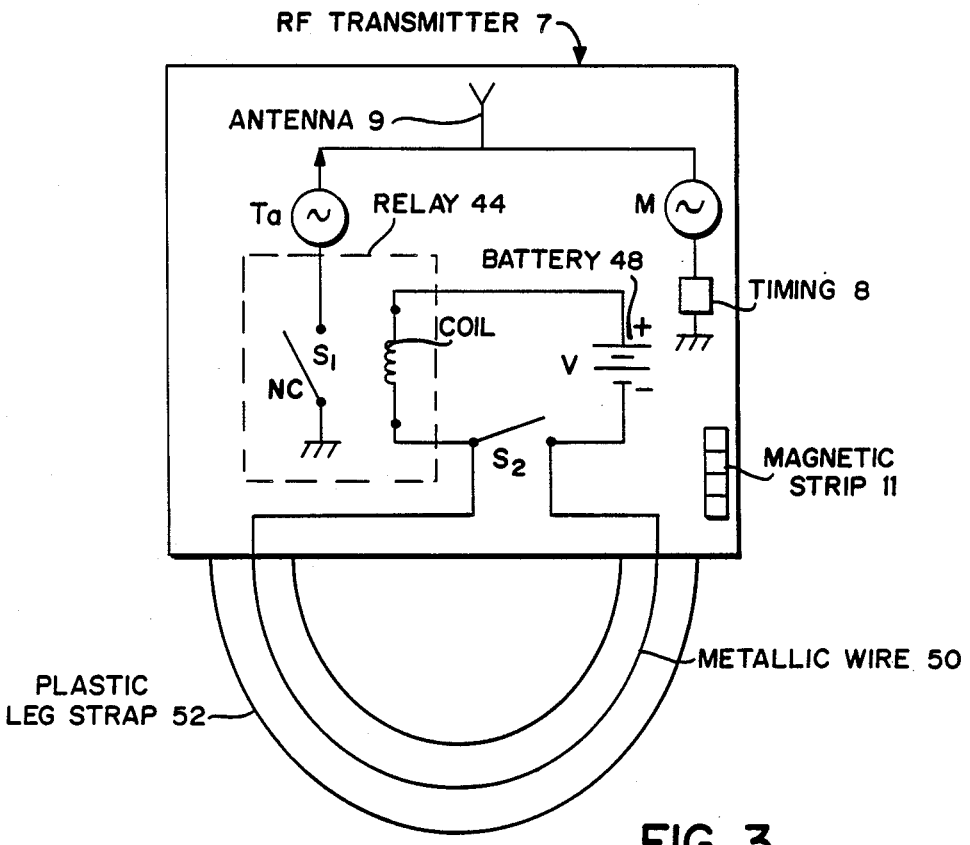
FIG. 3 is a schematic diagram of a RF transmitter and the plastic leg strap which may be used in the infant security system shown in FIG. 1.

FIG. 3 shows an exemplary circuit for achieving such coaction between switching elements S1 and S2 using a simple DC relay 44. If no current passes through the coil 46 of relay 44, then the relay's normally closed contacts (i.e., switch S1) will be in the closed position. However, if current flows through coil 46, then switch S1 will be in the open position as shown in FIG. 3.

In the infant security system exemplary embodiment of the present invention, under normal operating conditions, a short circuit is placed across the terminal of S2 by metallic wire 50 which is implanted in plastic leg strap 52. Thus, under normal conditions, battery 48 will be coupled to coil 46 and current will flow through the relay coil 46. This current flow holds switch S1 in the open position maintaining tamper signal generator Ta in a de-energized state. However, if a kidnapper cuts plastic leg strap 52 (and metallic wire 50), then the current flow to coil 46 will be interrupted, thereby causing switch S1 to close and tamper signal generator Ta to be energized.

The RF transmitter module 7 shown in FIG. 3 is small and lightweight so that it may comfortably wrap around an infant's leg without interfering with the movement of the infant. The RF transmitting module 7 and associated band 52 somewhat resemble a watch with the RF circuitry encapsulated in a rugged plastic enclosure at the head of the watch.

When the present invention is utilized to protect, for example, valuable art objects, it is contemplated that the switching module SW and switches S1 and S2 will be implemented by a conventional mechanical switching module having two switches which are coupled such that when one switching contact is closed, the other is opened and vice versa.

When, for example, the present invention is used for protecting a valuable art object, the method of mounting the RF transmitter 7 to the valuable object must served to close or otherwise place a short circuit across switch S2. If the switch S2 shown in FIG. 1 was, prior to mounting, spring biased to be in the normally opened position then the transmitter would be mounted to the valuable object such that switch S2 is forced to the closed position shown in FIG. 1.

Thus, if an attempt is made to physically separate the RF transmitter 7 from the valuable object, switch S2 will return to its normally open position. Thus, as long as the RF transmitter 7 remains attached to the valuable object, switch S2 is closed, switch S1 is opened (as shown in FIG. 1) and the tamper signal generator Ta is off. However, if the RF transmitter 7 is physically removed from the valuable object, switch S2 will open, switch S1 will close and the tamper signal generator Ta will be turned on resulting in the transmission of coded signals A.

Regardless of the object to be secured, the design of the RF transmitter package must be such that the terminals of switch S2 are not accessible. If a thief or kidnapper can place an external short circuit across switch S2, then the RF transmitter 7 can be removed from the valuable object without transmitting the tamper code A. Thus, switch S2 shown in FIG. 1 when protecting valuable objects will have its terminals disposed in a non-accessible position between the valuable object and the RF transmitting module 7. In the infant security embodiment, switch S2 is encapsulated in rugged plastic which houses all the RF transmitting circuitry.

In addition to making the terminals of switch S2 inaccessible, the present invention optionally contemplates the use of a monitored tamper loop. A monitored tamper loop is shown in FIG. 4, where a fixed resistance R is placed across switch S2 in the plastic leg strap wire 52. As long as the current detector 60 sees a current I approximately equal to the battery 48 voltage V divided by the predetermined fixed resistance R across switch S2, the current detector 60 will maintain S1 in an open circuit position so that tamper signal generator Ta will not be energized and will remain off. However, if switch S2 is either open circuited or short circuited, then the current detector 60 will not detect the predetermined current flow (i.e., $I=V/R$) and will close S1, thereby turning on tamper signal generator Ta. Thus, in order for a thief or kidnapper to remove the transmitter module 7 from an infant without energizing tamper signal generator Ta (by placing a predetermined circuit across the terminals of S2), the thief must know the predetermined fixed resistance value R.

The RF signal generators Ta and M are transmitters which generate coded signals A and m, respectively. By way of example only, these RF signal generators employ a binary frequency modulated (FM) coding and operate at a frequency on the order of 314 megahertz. Such binary coded signals are generated by transmitting the RF signal such that at predetermined time intervals the signal is either on or off, thereby representing the values "1" or "0". A first predetermined combination of "1"'s and "0"s is utilized to represent a tamper signal A, whereas a second combination of "1's" and "0's" is utilized to represent the maintenance signal m. Each transmitting module 7 and associated receiver 13 is set to respectively transmit and receive unique codes.

RF signal generating devices Ta and M may be of the type sold as Sentrol model numbers 7201, 7202 or 7302 (out of Portland, Oreg.). In implementing signal generators Ta and M, switches such as those used in the Sentrol devices would be opened or closed to select a first distinct code representing a tamper signal A and a second distinct code representing maintenance signal m.

As shown in FIG. 1, the RF transmitting module 7 also includes a magnetic strip 11. The magnetic strip 11 is a thin strip of magnetic material which when activated produces a low frequency alternating electromagnetic field. The magnetic strip 11 is disposed on a portion of the RF transmitting module 7 which is not directly adjacent to the terminals of the transmitting antenna 9 (so as to avoid any potential problems relating to detuning the antenna 9). Alternatively, the magnetic strip 11 may be disposed on the plastic leg strap 52 which attaches the RF transmitting module 7 to the infant's leg.

The signal generated by the activated magnetic strip 11 is a low frequency signal that is not significantly attenuated after passing through most objects. Thus, if an infant is placed in a pillowcase or the like, the low frequency signal passes through the pillowcase without being significantly attenuated as would a much higher frequency signal. The magnetic strip 11 (and the associated activating/deactivating hardware) may be of the type produced by 3M Corporation and known as WHISPERTAPE.

The magnetic material in magnetic strip 11 upon being activated alternates its polarity at a low frequency to generate an alternating electromagnetic field which may be detected by an associated magnetic receiver. The security system of FIG. 1 thus includes a plurality of magnetic receivers 25, 29, etc., which are disposed at all portals, elevators, doorways, etc., through which one must pass to exit the maternity ward. Associated with each magnetic receiver 25 and 29 is an alarm 27 and 31, respectively.

The magnetic receivers 25,29 may of the type manufactured by 3M and used in association with the magnetic strip of the WHISPERTAPE system. These receivers serve to detect the electromagnetic field generated by the activated magnetic strip of any of the transmitting modules 7. If an activated magnetic strip 11 passes through a portal associated with a doorway 3 or elevator 5, an alarm 27, 31 associated with a magnetic receiver 25, 29 will be triggered.

Turning next to the RF receiver module 13 shown in FIG. 1, the receiver 13 has an antenna 15 which receives and detects the signals transmitted by an associated RF transmitting module 7. As was the case with the RF transmitting antenna 9, the RF receiving antenna 15 is impedance matched to the receiver channels A and m and has an omni-directional receiving pattern.

The RF receiver 13 has two channels m and A, the m channel being tuned to receive the maintenance signal m and the A channel being tuned to receive the tamper signal A. These channels are designed to receive only the specific coded signals transmitted by their companion RF transmitter 7 and to reject all other transmissions.

For example, each channel stores therein a set of "1's" and "0's" corresponding to the coded signals transmitted by the tamper signal generator Ta and the maintenance signal generator M, respectively. Each channel then receives an incoming bit stream and compares the input signal with its stored code.

In regard to channel A, if the coded signal A generated by the tamper signal generator Ta is detected by channel A, an audible alarm 17 is triggered and optionally a flashing light 19 is energized. Channel m in a similar manner detects the transmitted maintenance signal m, triggers alarm 17 and optionally flashing light 19 in the absence of detecting a maintenance signal for a predetermined time period. By mounting the receiver module 13 with its associated alarms on an infant's cart, the specific infant in danger is identified.

As noted above, maintenance signal m is emitted every Tm seconds If after Tm seconds the maintenance signal m has not been received, it is possible that the RF transmitter module 7 has been removed a large enough distance from its associated RF receiver 13 that the signal strength is too weak to be picked up. However, an alternative possibility is that the RF transmitter 7 has been damaged either intentionally or by accident. In either case, the receiver module 13 should trigger an alarm.

The transmitter module 7 and the associated receiving module 13 should be designed such that the transmitter's power and the receiver's sensitivity are sufficient to communicate at a distance of at least 100 feet. Under such circumstances, the transmitted signals would certainly be received by a receiver 13 disposed approximately 20 feet from its associated transmitter 7 (the distance which would typically separate an infant from its receiver containing cart).

There are, however, other reasons for the receiving module 13 not detecting a maintenance signal m. In this regard, there could be a temporary generation of RF noise in the vicinity which interferes with the operation of the receiver 13. Likewise, a large metal object may have been temporarily placed between the RF transmitter 7 and the receiver 13.

To minimize interference generated false alarms, the maintenance channel m is preferably designed such that it triggers alarms 17,19 only if it fails to receive several maintenance signals m in a row. That is, the receiver module 13 will not generate a maintenance alarm, unless maintenance signal m is not received for $T_R$ seconds, where $T_R$ is larger than $T_m$. The larger $T_R$ is chosen the smaller the probability of a false maintenance alarm being generated. However, increasing $T_R$ also increases the time before a legitimate maintenance alarm is triggered, if an infant or valuable art object is removed from its proper area of if the RF transmitter is destroyed. In order to properly balance these two concerns, setting $T_R$ to approximately ten seconds is a reasonable compromise.

Timing circuit 16 shown in block form in FIG. 1 represents a logic circuit for setting $T_R$. This circuit may be implemented by a slightly modified version of the timing circuit in FIG. 2 as shown in FIG. 5. In this regard, clock pulses of period Tc may be utilized to drive a counter 70 which is designed to count from 1 to N, where $N=T_R/Tc$ to thereby generate a counter output transition from logical "0" to "1" every $T_R$ seconds. One shot 42 in FIG. 2 is replaced by a flip flop 72 which triggers alarms 17,19 in response to a counter 72 output transition from logical "0" to "1". A signal from maintenance channel m, which indicates that a transmitted maintenance signal has been detected, is used to drive the reset input R of counter 72.

Thus, timing circuit 16 shown in FIG. 5 (or another similar timing circuit) is associated with receiving channel m for producing a maintenance alarm if maintenance signal m is not received for a predetermined $T_R$ seconds. A maintenance alarm is therefore generated within $T_R$ seconds if the power to the RF transmitter module 7 is interrupted or is too low or if the RF transmitter 7 is physically destroyed or if the RF receiver 13 is jammed with RF radiation.

From time to time it is necessary for an infant in a maternity ward to be moved from one room to another. Such movement presents potential problems for a security system which depends on an RF transmitter being reasonably close to an associated RF receiver.

This potential problem has been overcome in the present invention by the recognition that infants in a maternity ward spend almost all their time on a cart which contains the infant's crib. Occasionally infants are removed from the cart to be fed, bathed or examined but even under such circumstances they are typically within several yards of the cart. Thus, as shown in FIG. 1, the RF receivers 13A to 13Z are advantageously mounted on the infants' carts. Since the cart is contemplated to be moved, the RF receivers 13 are battery powered units.

As indicated above, each RF transmitting module 7 and associated receiver 13 have the same unique maintenance and tamper codes (m and A) and are used as matched pairs. In order to match the Sentrol RF transmitters referred to above, the receiver channels m and A may be of the type sold as Sentrol model 7001 Series single channel wireless receiver.

If there are many infants or valuable objects within a given area to be protected (as schematically represented in FIG. 1), then an RF transmitter module 7 must be mounted on each object. Each RF transmitter 7 must generate uniquely coded maintenance and alarm signals, and be associated with a companion RF receiving module 13.

The present invention additionally contemplates (particularly where objects to be secured remain stationary in a reasonably small area) that as opposed to having a separate receiver module 13 for each RF transmitting module 7, a companion channel of a multichannel receiver may be utilized instead. In this regard, the Sentrol model 7004 receiver may serve as a multichannel version of the previously mentioned Sentrol 7001. By using such a multichannel version each channel in the multichannel receiver shares the single antenna associated with the multichannel receiver, thereby avoiding the use of a separate receiving antenna for each receiver module 13 as in the embodiment shown in FIG. 1. Each channel in such a multichannel receiver is capable of detecting a unique transmitted code.

A further alternative to having a single RF receiver 13 tied to the infant's cart would be to place several RF receivers 13 (which are associated with a single RF transmitting module 7) around the maternity ward so that the infant with its attached RF transmitter 7 is never very far from an RF receiver 13. The outputs from these RF receivers 13 would be coupled together. This alternative has the disadvantage of increasing the amount of hardware required to implement the security system and likewise increasing the installation expense in view of the need to tie together the outputs of the associated RF receivers 13.

In the security system of the present invention an alarm condition is indicated by the tamper signal A being received by the RF receiver 13, the maintenance m not being received by RF receiver 13 for a predetermined period of $T_R$ seconds and the signal emanating from the magnetic strip 11 being received by a magnetic receiver 25, 29 etc. Either of these conditions trigger an audible alarm and optionally a flashing light.

The basic function of the alarm is to alert security personnel so that they can take appropriate action and to upset or interfere with the burglar or kidnapper. The alarm can consist of an audible horn or bell and/or a flashing light driven by the various receivers in the system.

In a more sophisticated embodiment of the present invention, it is contemplated that an alarm signal generated by a particular receiver may be sent to a central control panel so that exit doors may be locked, security personnel and/or police alerted, etc. Since the infant carts on which the RF receivers 13 are mounted are portable and are often moved, it is not practical to transmit such alarm signals to a central control panel by a fixed wiring system. Thus, the present invention contemplates transmitting a RF signal indicative of an alarm condition from each portable receiver 13 to a fixed receiver. Such a fixed receiver would then be wired to transmit a signal to a central control panel or the like.

Figure 6:
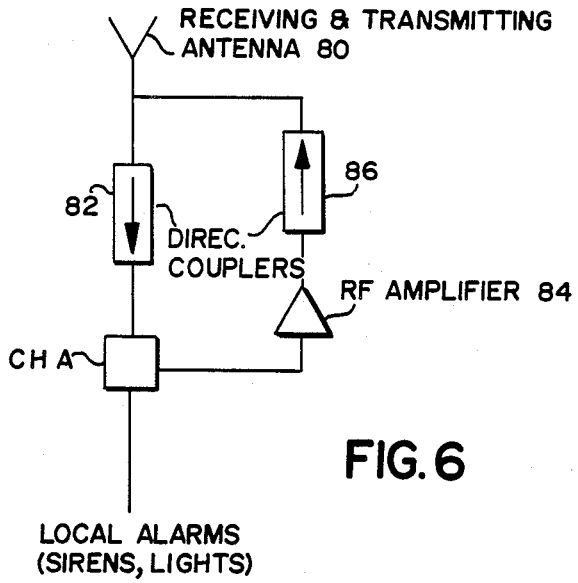
FIG. 6 is a block diagram of a RF transceiver that may be used in another embodiment of the present invention.

In accordance with this embodiment of the present invention, RF transmission is used to send alarm and/or other signals from the RF receivers 13 to a central control panel. FIG. 6 shows one technique for implementing such RF transmission for the alarm channel A of the RF receiver module 13. It should be understood that a similar implementation is used for the maintenance channel M. A RF transceiver is shown in FIG. 6 which includes two direction couplers 82, 86 and an RF amplifier 84. A directional coupler is a conventional device which permits RF energy to pass only if it is propagating in a predetermined direction (as represented by the arrows in FIG. 6).

As indicated in FIG. 6 when tamper signal A is received by antenna 80, it goes via coupler 82 to the channel A detector which in turn energizes local sirens and/or lights. Additionally, a portion of signal A is sent to RF amplifier 84, directional coupler 86 and then back to the antenna 80 to be reradiated.

Use of the RF transceiver shown in FIG. 6 has at least two advantages. First, the reradiated signal is uniquely coded exactly as the incoming alarm signal, and thus when it gets to the central control panel it will identify which RF transmitter 7 transmitted the original alarm signal (which will identify which infant is in danger). Also, it is not necessary for the RF transceiver to have the circuitry to generate the coded signal A. Since the RF transceiver is mounted on the infant cart, size is not a big problem, and thus it is practical to substantially amplify signal A prior to it being reradiated.

If the maternity ward is confined within a relatively small area (and if a central control panel is to be located in the ward), then it may be practical to rely on (through the air) RF transmission to get the radiated RF signal from the RF transceiver to the control panel. In this case, the control panel would have a receive antenna connected to a multichannel version of the RF receivers shown in FIG. 1.

Figure 7:
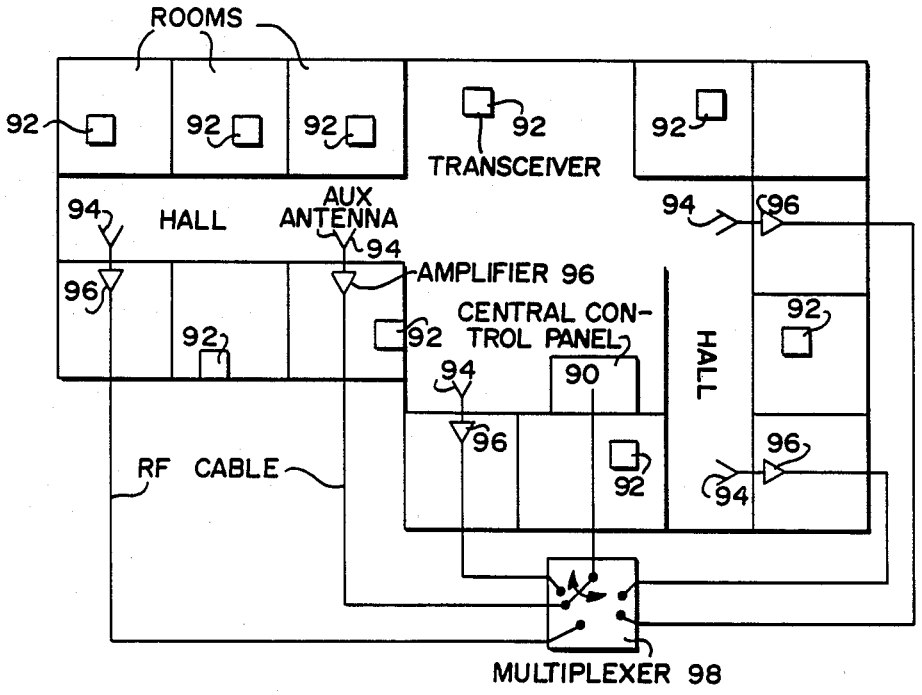
FIG. 7 is a block diagram of a communications system of an infant security system incorporating a central control panel.

If the maternity ward is large, as represented in FIG. 7, then there can be a large separation between many of the RF transceivers 92 and the central control panel 90. Since radiated power in free space varies inversely with the square of the distance, the RF signal strength at the control panel 90 may be too weak to be detected. Also, there may be many walls, heating ducts, and other hospital equipment between the RF transceivers 92 and the central control panel 90, which will further attenuate the signal. These other obstacles can even produce multiple reflections of the RF signal which could cancel each other at the central control panel 90.

The transmission system shown in FIG. 7 avoids such potential problems. In this system, auxiliary receive antennas 94 and associated amplifiers 96 are located around the maternity ward so that each of the RF transceivers 97 are reasonably close to at least two of the auxiliary receive antennas 94 at any time (even as the infant cart is moved to various locations in the ward). If an RF transceiver 92 sends an alarm signal, there is a very high probability that it will be received by at least one of these auxiliary antennas 94. The outputs of the auxiliary antennas 94 are amplified by amplifiers 96 and sent by RF cable to the central control panel 90. A conventional multiplexer 98 is used to couple one auxiliary antenna line at a time to control panel 90 so that signals from several auxiliary antennas 94 can not interfere with each other at he central control panel 90.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

We claim:

1. An infant security system for thwarting the kidnapping of infants from a children's ward or maternity ward of a hospital or the like having at least one exit through which an infant may be transported, said infant security system comprising:

at least one transmitting means for transmitting infant security indicating signals, said at least one transmitting means being securably attached to an infant to be monitored, and including tamper signal generator means for generating at least a first unique coded tamper signal indicative of tampering with said at least one transmitting means, and including means for periodically generating a second unique coded signal;

at least one receiving means associated with said at least one transmitting means for detecting said unique signals and for generating alarm condition signals in response to the detection of the first unique signal and the failure to detect the second unique signal;

said means for periodically generating including maintenance signal generator means for periodically generating said second unique coded signal indicative of the infant being within a predetermined distance of said at least one said receiving means and not being shielded from said at least one receiving means; and alarm means, responsive to said alarm condition signals, for providing an indication of said alarm condition.

2. An infant security system according to claim 1, wherein said at least one transmitting means includes antenna means coupled to said means for generating for transmitting signals input thereto.

3. An infant security system according to claim 2, wherein said transmitting means is a radio frequency (RF) transmitter and wherein said antenna means emits a substantially omni-directional radiation pattern.

4. An infant security system according to claim 1, further including switch means, coupled to said tamper signal generator means, for initiating the generation of said coded tamper signal upon detecting a tampering indicating condition.

5. An infant security system according to claim 4, wherein said switch means coupled to said tamper signal generator means includes first switch means for normally preventing energizing signals from initiating the operation of said tamper signal generator means, and second means operatively coupled to said first switch means for controlling said first switch means to pass energizing signals to said tamper signal generating means upon detection of a tampering indicating condition.

6. An infant security system according to claim 5, wherein said first switch means and said second means coact such that when said second means is in a closed circuit condition said first switch means is in an open circuit condition, and when said second means is in an open circuit condition, the first switch means is in a short circuit, signal passing condition.

7. An infant security system according to claim 5, wherein said second means includes two terminals, a voltage source connected to one of said terminals and a coil operatively coupled to said first switch means, and wherein one end of a metallic wire is connected to each of said terminals to place a short circuit across said terminals to permit current flow through said coil.

8. An infant security system according to claim 4, wherein said switch means includes first switch means for normally preventing said tamper signal generator means from being energized, and tamper loop means for detecting a tampering condition and for controlling said first switch means to energize said tamper signal generator means.

9. An infant security system according to claim 1, wherein said at least one transmitting means further includes energizable means for generating a signal which may be detected when said at least one transmitting means is disposed within a predetermined distance from an associated detector means.

10. An infant security system according to claim 9, further including at least one detector means disposed at said at least one exit for detecting signals generated by said energizable means, and exit alarm means associated with said at least one detector means for providing an indication of an alarm condition.

11. An infant security system according to claim 1, wherein said at least one receiving means includes first channel means for detecting the presence of a first of said at least two unique signals and for generating an alarm triggering signal in response to detecting said first of said at least two unique signals, and second channel means for detecting a second of said at least two unique signals and for generating an alarm triggering signal in response to detecting the absence of said second one of said at least two unique signals for a predetermined period of time;

said at least one receiving means including means responsive to said alarm triggering signals for providing an indication of an alarm condition.

12. An infant security system according to claim 1, wherein said at least one receiving means is mounted on or adjacent to the crib of the infant attached to the transmitting means associated with said at least one receiving means.

13. An infant security system according to claim 1, wherein said at least two unique signals are coded with binary frequency modulated coding.

14. An infant security system according to claim 1, wherein said at least one transmitting means is encapsulated in rugged plastic and is attached to the infant by a plastic leg strap.

15. An infant security system according to claim 1, wherein said at least one receiving means includes means for retransmitting said detected unique signals.

16. An infant security system according to claim 15, further including a plurality of auxiliary receiving means for receiving said retransmitted unique signals;

a central control panel for receiving signals transmitted from said at least one receiving means; and means for coupling said auxiliary receiving means to said central control panel.

17. A valuable object security system for thwarting the kidnapping or unauthorized taking of said object from a predetermined area having at least one exit, said valuable object security system comprising:

transmitting means securably attached to said valuable object for transmitting security indicating signals;

said transmitting means including:

tamper signal generating means for generating a unique coded tamper signal indicative of unauthorized tampering with said transmitting means, maintenance signal generating means for periodically generating a unique coded maintenance signal indicative of the valuable object being within said predetermined area;

receiving means associated with said transmitting means and including first channel means for detecting said tamper signal and for generating an alarm triggering signal in response thereto, second channel means for detecting said periodically generated maintenance signal and for generating an alarm triggering signal in response to detecting the absence of a maintenance signal for a predetermined period of time; and alarm means responsive to said alarm triggering signals for providing an indication thereof.

18. A valuable object security system according to claim 17, wherein said valuable object is an infant and said predetermined area is a maternity ward or children's ward in a hospital.

19. A valuable object security system according to claim 17, wherein said transmitting means further includes energizable means for generating a signal which may be detected when said at least one transmitting means is disposed within a predetermined distance from an associated detector means.

20. A valuable object security system according to claim 19, further including at least one detector means disposed at said at least one exit for detecting signals generated by said energizable means, and exit alarm means associated with said detector means for providing an indicating of an alarm condition.

21. A valuable object security system according to claim 17, wherein said transmitting means includes antenna means coupled to receive signals from said tamper signal generating means and said maintenance signal generating means for transmitting signals input thereto.

22. A valuable object security system according to claim 21, wherein said transmitting means is a radio frequency (RF) transmitted and wherein said antenna means emits a substantially omni-directional radiation pattern.

23. A valuable object security system according to claim 17, further including switch means, coupled to said tamper signal generator means, for initiating the generation of said coded tamper signal upon detecting a tampering indicating condition.

24. A valuable object security system according to claim 23, wherein said switch means coupled to said tamper signal generating means includes first switch means for normally preventing energizing signals from initiating the operation of said tamper signal generating means, and second means operatively coupled to said first switch means for controlling said first switch means to pass energizing signals to said tamper signal generating means upon detection of a tampering indicating condition.

25. A valuable object security system according to claim 24, wherein said first switch means and second means coact such that when said second means is in a closed circuit condition, said first means is in an open circuit condition and when said second means in an open circuit condition, the first switch means is in a short circuit, signal passing condition.

26. A valuable object security system according to claim 24, wherein said second means includes two terminals and wherein one end of a metallic wire is connected to each terminal to place a short circuit across said terminals to thereby maintain said first switch means in an open circuit condition.

27. A valuable object security system according to claim 23, wherein said switch means includes a first switch means for normally preventing said tamper signal generating means from being energized and tamper loop means for detecting a tampering condition and for controlling said first switch means to energize said tamper signal generating means.

28. A valuable object security system according to claim 17, wherein said receiving means includes means for retransmitting said detected unique coded signals.

29. A valuable object security system according to claim 28, further including a plurality of auxiliary receiving means for receiving said retransmitted unique coded signals;

a central control panel for receiving signals transmitted from said receiving means; and means for coupling said auxiliary receiving means to said central control panel.

30. For use in a valuable object security system for thwarting the kidnapping or unauthorized taking of said valuable object from a predetermined area having at least one exit, a security signal transmitting device to be securably attached to said valuable object comprising;

tamper signal generating means for generating a unique coded tamper signal indicative of unauthorized tampering with said transmitting means; and maintenance signal generating means for periodically generating coded maintenance signals indicative of the valuable object being within said predetermined area, whereby the reception of the tamper signal by an associated receiving device indicates an unauthorized tampering with the transmitting means and the failure to detect the maintenance signal by said associated receiving device indicates the breach of a security condition.

31. A transmitting device according to claim 30, further including switch means, coupled to said tamper signal generating means, for initiating the generation of said coded tamper signal upon detecting a tampering indicating condition.

32. A transmitting device according to claim 31, wherein said switch means coupled to said tamper signal generating means includes first switch means for normally preventing energizing signals from initiating the operation of said tamper signal generating means, and second means operatively coupled to said first switch means for controlling said first switch means to pass energizing signals to said tamper signal generating means upon detection of a tampering indicating condition.

33. A transmitting device according to claim 32, wherein said first and second means coact such that when said second means is in a closed circuit condition, said first switch means is in an open circuit condition and when said second means is in an open circuit condition the first switch means is in a short circuit, signal passing condition.

34. A transmitting device according to claim 32. wherein said second means includes two terminals and wherein one end of a metallic wire is connected to each terminal to place a short circuit across said terminals to thereby maintain said first switch means in an open circuit condition.

35. A transmitting device according to claim 31, wherein said switch means includes first switch means for normally preventing said tamper signal generating means from being energized and tamper loop means for detecting a tampering condition and for controlling said first switch means to energize said tamper signal generator.

36. A transmitting device according to claim 34, wherein said first switch means comprises relay means for preventing when energized said tamper signal generating means from generating a coded tamper signal, said second means including a voltage source for energizing said relay means as long as said short circuit remains intact.

37. A transmitting device according to claim 30, further including energizable means for generating a signal which may be detected when said at least one transmitting means is disposed within a predetermined distance from an associated detector means.

38. A transmitting device according to claim 30, further including antenna means coupled to said tamper signal and maintenance signal generating means for transmitting signals input thereto.

39. A transmitting device according to claim 38, wherein said transmitting device is a radio frequency (RF) transmitter and wherein said antenna means emits a substantially omni-directional radiation pattern.

40. A transmitting device according to claim 30, wherein said at least two unique signals are coded with binary frequency modulated coding.

41. A transmitting device according to claim 30, wherein said transmitting device is encapsulated in a rugged plastic and includes plastic leg strap means for attaching said transmitting device to the leg of an infant.

42. For use in a valuable object security system for thwarting the kidnapping or unauthorized taking of said valuable object from a predetermined area having at least one exit, said security system having at least one transmitting means for transmitting coded security signals, a security signal receiving device comprising:

first channel means for detecting a uniquely coded tamper signal indicative of unauthorized tampering with said transmitting means for generating an alarm triggering signal in response thereto;

second channel means for detecting a periodically generated maintenance signal indicative of the valuable object being within said predetermined area and for generating an alarm triggering signal in response to the absence of a detected maintenance signal for a predetermined period of time; and alarm means responsive to said alarm triggering signals for providing an alarm condition indicating signal.

43. A receiving device according to claim 42, wherein said first channel means and said second channel means includes means for detecting binary coded frequency modulated signals.

44. A receiving device according to claim 42. wherein the valuable object is an infant and wherein said receiving device is mounted on or adjacent to the crib of an infant attached to a transmitting means associated with said receiving device.

45. A receiving device according to claim 42, including means for retransmitting said detected unique signals, whereby said signals may be transmitted to a central control panel.

46. A method of thwarting the kidnapping of infants from the maternity ward of a hospital or the like having at least one exit through which an infant may be transported, said method comprising the steps of:

securably attaching a transmitting means to each of a plurality of infants;

generating and transmitting coded signals from each transmitting means indicative of predetermined infant security conditions;

detecting with a receiver means associated with said transmitting means said transmitted coded signals;

said step of generating and transmitting coded signals including the step of periodically generating coded signals from each of said transmitting means indicative of the infant being within a predetermined distance of an associated receiver means and not being shielded form said associated receiver means; and selectively energizing an alarm upon the detection of an infant security condition which may be indicative of the abduction of an infant.

47. A method according to claim 46, including the step of generating a uniquely coded tamper signal indicative of tampering with said transmitting means.

48. A method according to claim 46, further including the steps of generating a signal by an energizable means in each of said transmitting means which may be detected when any one of said transmitted means is disposed within a predetermined distance from an associated detector detector means.

49. A method according to claim 48, further including the step of disposing at least one detector means at predetermined exit areas for detecting signals generated by said energizable means, and providing an indication of an alarm condition in response to detecting signals from said energizable means.

50. A method according to claim 46, further including the step of mounting said receiving means on or adjacent to the crib of the infant wearing the transmitting means associated with said receiving means.

51. A method according to claim 46, including retransmitting said detected unique signals to a central control station.

52. A method according to claim 51, further including receiving said retransmitted unique coded signals by a plurality of auxiliary receiving means and coupling said signals received by said auxiliary receiving means to said central control station.

53. A method for thwarting the kidnapping of infants from the maternity ward of a hospital or the like having at least one exit through which an infant may be transported, said method comprising the steps of:

securably attaching a transmitting means to each of a plurality of infants in the maternity ward;

periodically generating and transmitting a first uniquely coded "I'm Okay" signal from each of said transmitting means;

generating and transmitting from a transmitting means a second uniquely coded tamper signal if said transmitting means is tampered with;

detecting with a receiver means associated with said transmitting means a tamper signal and generating an alarm triggering signal in response thereto;

detecting with said receiver means associated with said transmitting means said "I'm Okay" signal and generating an alarm triggering signal in response to the absence of detecting said I'm Okay signal for a predetermined period of time; and providing an alarm in response to said alarm triggering signals.

54. A method according to claim 53, further including the step of disposing an energizable means on each of said transmitting means for generating a signal which may be detected when one of said transmitting means is disposed within a predetermined distance of from an associated detector mounted at an exit.

55. A method according to claim 52, further including the step of mounting said receiver means on or adjacent to the crib of the infant wearing the transmitting means associated with said receiving means.

56. A method according to claim 53, including retransmitting said detected unique signals to a central control station.

57. A method according to claim 56, further including receiving said retransmitted unique coded signals by a plurality of auxiliary receiving means and coupling said signals received by said auxiliary receiving means to said central control station.

* * * * *